United States Patent [19]

Jones

[11] 4,331,420

[45] May 25, 1982

[54] REVERSIBLE UNIDIRECTIONAL FLOW PUMP WITH FRICTIONALLY ENGAGED AXIAL VALVE PLATE

[75] Inventor: Othel L. Jones, Shelby County, Ohio

[73] Assignee: Copeland Corporation

[21] Appl. No.: 150,232

[22] Filed: May 15, 1980

Related U.S. Application Data

[63] Continuation of Ser. No. 945,237, Sep. 25, 1978, abandoned.

[51] Int. Cl.[3] ..... F04C 15/02

[52] U.S. Cl. ..... 418/32

[58] Field of Search ..... 418/32; 417/315

[56] References Cited

U.S. PATENT DOCUMENTS

| | | | |
|---|---|---|---|
| 1,722,595 | 7/1929 | Rose | 417/315 |
| 2,151,482 | 3/1939 | Neeson | 417/315 |
| 2,751,145 | 6/1956 | Olcott | 418/32 |
| 3,039,677 | 6/1962 | Nissley | 418/32 |
| 3,165,066 | 1/1965 | Phelps et al. | 418/32 |
| 3,208,392 | 9/1965 | Garrison et al. | 418/32 |
| 3,273,501 | 9/1966 | Tothero | 418/32 |
| 3,302,869 | 2/1967 | Tchen | 418/32 |
| 3,343,494 | 9/1967 | Erikson et al. | 418/32 |
| 3,418,939 | 12/1968 | Kopp | 418/32 |
| 3,478,693 | 11/1969 | Bangs | 418/32 |
| 3,985,473 | 10/1976 | King et al. | 417/315 |

FOREIGN PATENT DOCUMENTS

| | | | |
|---|---|---|---|
| 808088 | 7/1951 | Fed. Rep. of Germany | 418/32 |
| 869967 | 11/1941 | France | 418/32 |

*Primary Examiner*—John J. Vrablik

*Attorney, Agent, or Firm*—Harness, Dickey & Pierce

[57] ABSTRACT

A reversible positive displacement rotary fluid pump comprising a rotor with dual sliding vanes defining pumping cavities of increasing and decreasing volume and having a single non-valved inlet for both directions of rotation, outlet flow being controlled by a valve plate rotatable to one of two positions, as determined by the direction of rotation of the pump, and a stationary porting plate.

20 Claims, 6 Drawing Figures

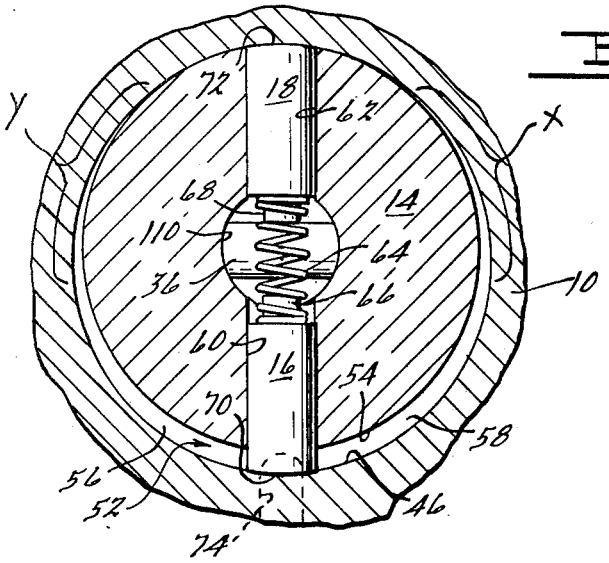
Fig. 2.
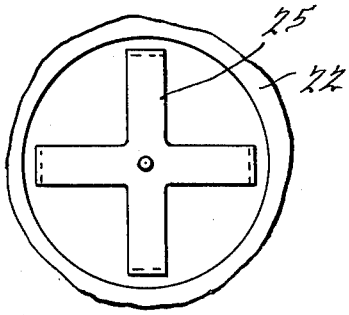
Fig. 6.
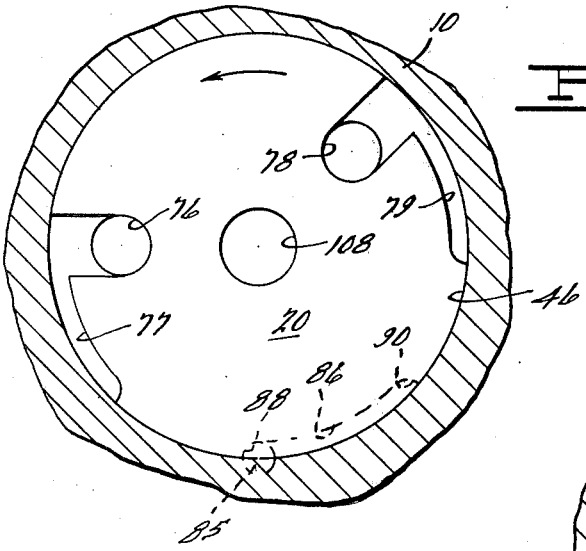
Fig. 3.
Fig. 4.
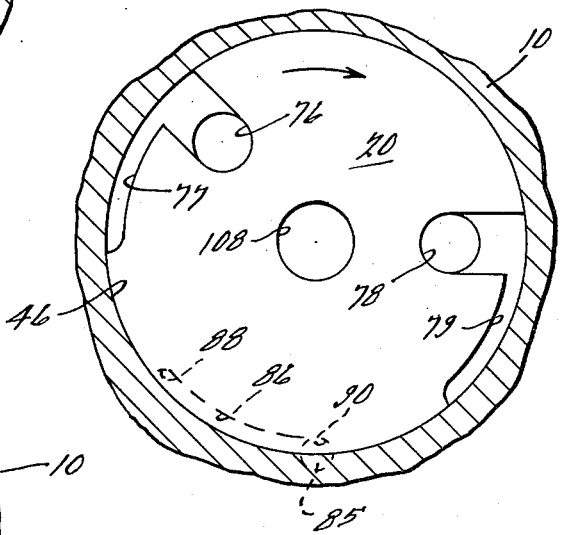
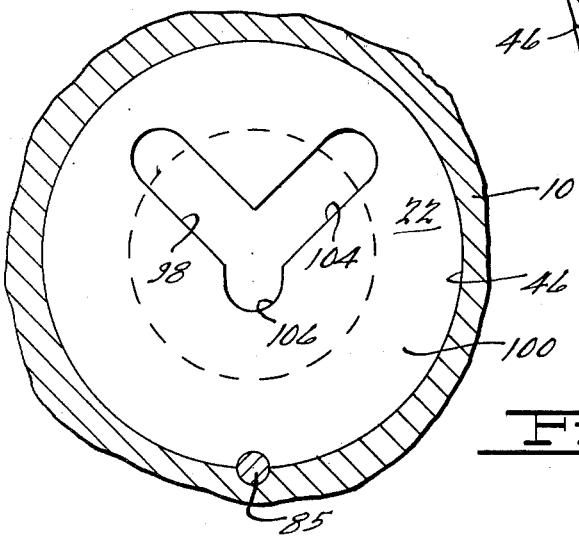
Fig. 5.

REVERSIBLE UNIDIRECTIONAL FLOW PUMP WITH FRICTIONALLY ENGAGED AXIAL VALVE PLATE

This is a continuation of application Ser. No. 945,237, filed Sept. 25, 1978, now abandoned.

BACKGROUND AND SUMMARY OF THE INVENTION

The present invention relates to a positive displacement rotary vane pump of the reversible type which automatically provides unidirectional discharge flow, regardless of direction of rotation. Reversible pumps are useful in many applications, such as for oil pumps for lubricating three-phase powered refrigeration compressors, which are run in clockwise or counterclockwise directions because the start-up of such compressors can result in rotation in either direction.

Rotary pumps adapted to provide unidirectional flow regardless of direction of rotation of the pump are known in the art. For example, U.S. Pat. Nos. disclosing reversible rotary vane pumps include 1,722,595 and 3,985,473. Other pumps providing unidirectional output include gear pumps, such as disclosed in U.S. Pat. Nos. 2,151,482; 3,165,066; 3,208,392; and 3,343,494. And a reversible shear pump is disclosed in U.S. Pat. No. 3,039,677.

It is an object of the present invention to provide an improved reversible, unitary flow pump, and particularly one which reliably has relatively few parts and can be economically constructed and maintained. A further object is to provide a rotary pump having improved automatic valve means providing unidirectional output regardless of direction of rotation. A related object concerns the provision of such a pump which does not require inlet valving.

These and other objects, features and advantages of the present invention will be apparent from the following description and appended claims, taken in conjunction with the accompanying drawing.

BRIEF DESCRIPTION OF THE DRAWING

FIG. 2 is a sectional view taken along line 2—2 of FIG. 1 illustrating the pumping chamber of the present invention;

FIG. 3 is a sectional view taken along line 3—3 of FIG. 1, showing the valve plate of the present invention in a counterclockwise position to accommodate one direction of rotation;

FIG. 4 is a view similar to FIG. 3 but showing the valve plate in a clockwise position to accommodate rotation in the opposite direction;

FIG. 5 is a sectional view taken along line 5—5 of FIG. 1 showing the porting plate of the present invention; and FIG. 6 is a sectional view taken along line 6—6 of FIG. 1.

DESCRIPTION OF THE PREFERRED EMBODIMENT

Figure 1:
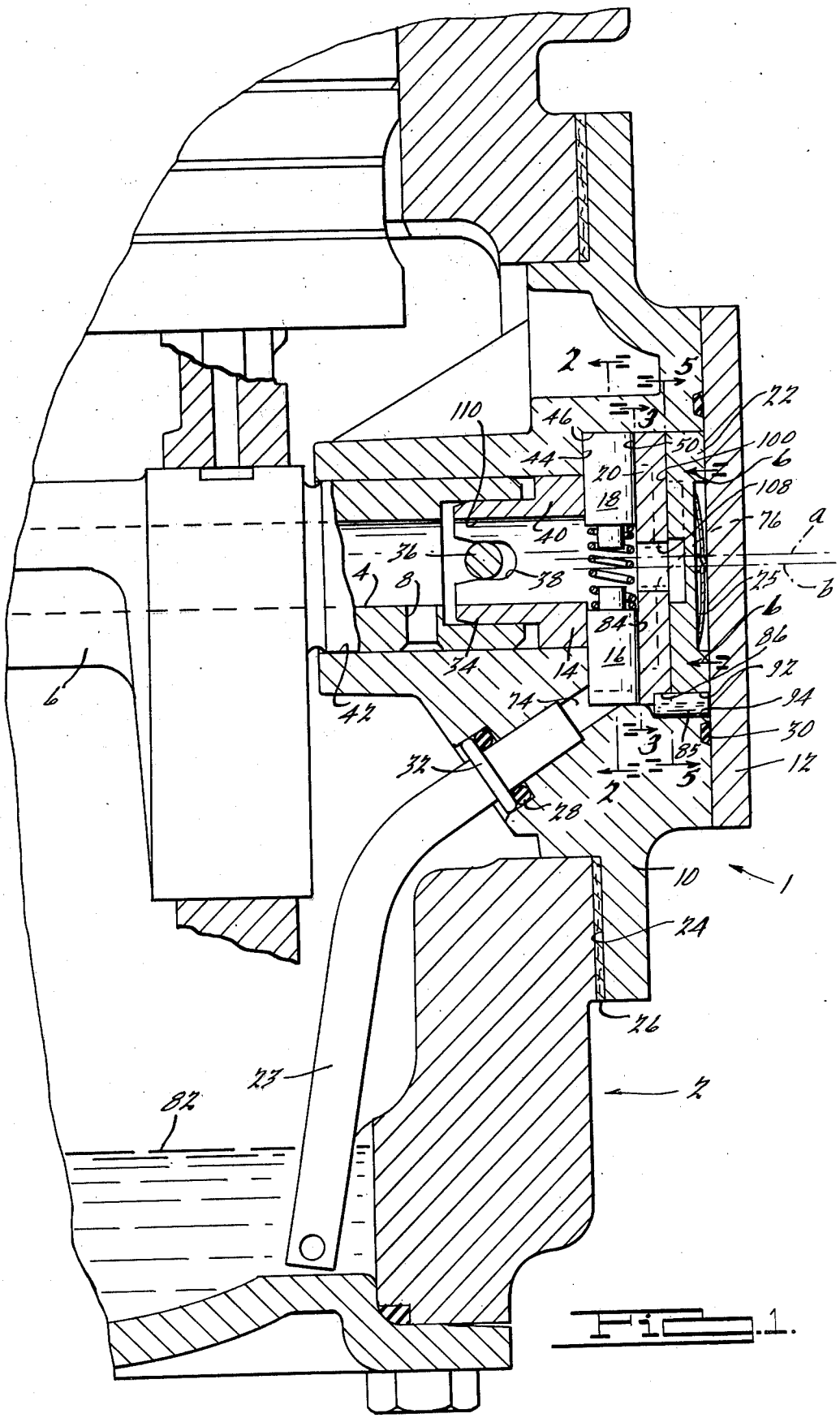
FIG. 1 is a vertical sectional view of a reversible fluid pump of the present invention in operative association with a compressor (partially shown)

The present invention relates to a novel rotary vane pump of the positive displacement type which provides a unidirectional output regardless of the direction of rotation of the shaft driving the pump. The pump features a single inlet port which is used for both directions of rotation. The pump also features an output valve means comprising a pair of outlet ports in a movable valve plate and a channeled porting plate, one of the outlet ports being aligned with one of the channels in the porting plate for one rotational direction, the other outlet port being aligned with another of the channels for the opposite rotational direction.

Now referring to the drawing, where like numbers refer to like parts in the various figures, a reversible pump 1 of the present invention is shown in FIG. 1. Pump 1 is shown in operative association with a refrigeration compressor 2 (such as one of the general type disclosed in U.S. Pat. No. 2,298,749) and has the function of supplying lubricating oil to bore 4 in compressor crankshaft 6. Lubricating oil is supplied to the various other parts of compressor 2 from bore 4 in a conventional manner. For example, one end of crankshaft 6 is lubricated by means of lubricating passage 8. Of course, it will be appreciated that pump 1 is suitable for other uses, which are all contemplated to be within the broad scope of this invention.

One of the advantages attendant to the present invention is that pump 1 comprises relatively few basic parts, and hence can be economically manufactured, assembled and maintained. The basic parts of pump 1 are a pump housing 10 which; in conjunction with a housing cover 12, encloses an impeller 14 having rotary vanes 16 and 18 slidably mounted thereon, a movable valve plate 20, a porting plate 22, an inlet tube 23, and a thrust washer 25 for biasing the porting plate, valve plate and impeller against one another. The terms "axially", "radially", and "transversely" as used herein are with reference to the common axis of rotation of impeller 14 and compressor crankshaft 6, indicated at a in FIG. 1.

Pump housing 10 may be of any desired external configuration consistent with the use of pump 1. As shown in FIG. 1, pump housing 10 is mounted at the end of refrigeration compressor 2 and has a mounting surface 24 of a configuration adapted to fit upon the corresponding surfaces of compressor 2. It will be appreciated that other configurations adapted to fit other compressors or other apparatus are consistent with the present invention. In the particular embodiment of the present invention shown in FIG. 1, a conventional annular gasket 26 and O-rings 28 and 30 are sealably disposed between pump housing 10 and compressor 2, between a flange 32 on tube 23 and housing 10, and between housing cover 12 and housing 10, respectively.

Pump housing 10 has centered on axis a a bore 42 in which the end of crankshaft 6 is disposed and an enlarged circular cylindrical bore 46 communicating therewith and centered on eccentric axis b, and a transverse shoulder 44 therebetween. Impeller 14, which has vanes 16 and 18 mounted thereon, valve plate 20 and porting plate 22 are disposed within bore 46. Impeller 14 is rotatably driven by compressor crankshaft 6, which fits coaxially over a reduced diameter cylindrical end portion 34 of impeller 14. Relative rotation between crankshaft 6 and impeller 14 is prevented by a pin 36 which extends transversely through compressor crankshaft 6 and fits into notches 38 in end portion 34.

As shown in FIGS. 1 and 2, shoulder 44 and eccentric bore 46 of valve housing 10 cooperate with inner face 50 of movable valve plate 20 and outer peripheral surface 54 of impeller 14 to define a pumping cavity 52. Pumping cavity 52 is divided into two rotating pumping chambers 56 and 58 by means of opposed vanes 16 and 18 which are slidably carried in radially outwardly extending slots 60 and 62 in impeller 14. Vanes 16 and 18 are biased radially outwardly against the surface of bore 46 by a compression spring 64 which fits over reduced end portions 66 and 68 of vanes 16 and 18. Thus, outer ends 70 and 72 of vanes 16 and 18 are maintained in continuous sealing engagement with the wall of bore 46.

The flow of fluid into and out of pumping cavity 52 is provided by means of an inlet port 74 communicating with cavity 52 through shoulder 44, and outlet ports 76 and 78 in movable valve plate 20. Inlet tube 23 extends from oil reservoir or sump 82 into housing 10 where it communicates with inlet port 74. The lower end of tube 23 is in fluid communication with oil in sump 82.

Movable valve plate 20 is adapted for limited rotational movement in response to the frictional force exerted on face 50 by outer face 84 of impeller 14 when rotating in a clockwise or counterclockwise direction. Rotation of movable valve plate 20 in both directions is limited by suitable stop means, such as a pin 85 which extends into a channel 86 having ends 88 and 90 and located at the periphery of movable valve plate 20. Pin 85 also serves as locking means, as best shown in FIGS. 1, 3 and 5, because it is disposed in slot 92 in porting plate 22 and slot 94 in pump housing 10, to thereby align and locate the respective parts of pump 1. Thrust washer 25 operates between cover 12 and porting plate 22 so that the latter will bias valve plate 20 against impeller 14 to create the friction necessary to cause the impeller to give limited rotation to the valve plate. As best seen in FIGS. 1 and 6, thrust washer 25 has a plurality of radially outwardly extending legs, the ends of which engage porting plate 22, and in the center an outwardly projecting boss which engages cover 12.

Outlet port 78 extends axially through movable valve plate 20 and is adapted to communicate with a channel 104 in face 100 of porting plate 22 when movable valve plate 20 is in its counterclockwise position, as shown in FIGS. 3 and 5. Outlet port 76 similarly extends through movable valve plate 20 and is adapted to communicate with a channel 98 in face 100 of porting plate 22 when movable valve plate is in a clockwise position, as shown in FIGS. 4 and 5. Outlet ports 76 and 78 communicate with arcuate recesses 77 and 79, respectively, at the periphery of the valve plate in order to provide a discharge zone of sufficient length to obtain efficient pumping. Channels 98 and 104 extend radially and communicate with a center depression 106 which is aligned with a central bore 108 extending completely through movable valve plate 20 and communicating with a central bore 110 through impeller 14, which in turn communicates with bore 4 of compressor crankshaft 6 and hence the lubrication network of compressor 2. Bore 110 also acts as a bearing support for impeller 14, which has the advantage that the pump can be tested independently of the compressor.

A further appreciation of the present invention will be obtained from the following description of the operation of pump 1. In accordance with the invention, upon rotation of compressor crankshaft 6, say in a counterclockwise direction as viewed from the left in FIG. 1, impeller 14 will be similarly driven. Friction between face 84 of impeller 14 and face 50 of movable valve plate 20 will rotate valve plate 20 in its counterclockwise position shown in FIG. 3, with stop pin 85 abutting against end 88 of groove 86. Continued counterclockwise rotation of impeller 14 causes oil to be pumped from reservoir 82 into pumping cavity 52 and out through outlet port 78, channel 104, center depression 106, bore 108, bore 110 and into port 4 of crankshaft 6, in the following manner.

Referring to FIG. 2 it can be seen that vanes 16 and 18 divide pumping cavity 52 into two rotating pumping chambers 56 and 58, each of which is of increasing and decreasing volume as impeller 14 rotates. In FIG. 2, vane 16 is shown at inlet port 74 and pumping chambers 56 and 58 are shown as being of equal volume. The discharge zone indicated at Y is the one provided by recess 79 and outlet port 78, and discharge zone X is provided by recess 77 and outlet port 76. As impeller 14 and vane 16 rotate past inlet port 74 in the counterclockwise direction, as viewed in FIGS. 3–5 (clockwise as viewed in FIG. 2), pumping chamber 56 will decrease in size and pumping chamber 58 will increase in size with the result that fluid will be pulled into pumping chamber 58 from oil reservoir 82 through inlet port 74 until vane 16 reaches discharge zone Y, at which point pumping chamber 58 will be of maximum volume. Further rotation of impeller 14 will cause pumping chamber 58 to decrease in volume, forcing fluid out through recess 79 and outlet port 78. Although fluid will also be discharged through inlet port 74, probably because of the dynamics of the system, this does not seem to seriously hinder successful operation of the pump. Upon further rotation of impeller 14, vane 18 will pass inlet port 74 and thereafter all the remaining fluid in chamber 56 will be pumped out through recess 79 and outlet port 78, this cycle continuing until vane 18 has passed recess 79 and outlet port 76 (zone Y). Between this position (the trailing vane having just passed the discharge port) and the position in which the leading vane passes the inlet port, rotation of the impeller causes a vacuum to be created in chamber 58, so that when the inlet port is opened a substantial pressure differential exists to accelerate fluid induction. Outlet port 76 is not aligned with channel 104 or 98 and hence provides no outlet for fluid in the pumping chambers for this direction of rotation. The pumping processes of pumping chambers 56 and 58 are identical (merely 180° out of phase), so that two discharge cycles will occur each revolution of impeller 14. The construction of pump 1 allows use of a single inlet port, which is one of the unique and desirable features of the present invention because of the simplicity it provides.

As can be readily visualized, upon rotation of compressor crankshaft 6 in the opposite direction, fluid will be pumped outwardly through recess 77 and outlet port 76 in an analogous fashion. Thus, clockwise rotation of crankshaft 6 (as viewed in FIGS. 3–5) will frictionally rotate movable valve plate 20 to its full clockwise position as shown in FIG. 4. In this position, outlet port 76 is aligned and in communication with channel 98 in porting plate 22, which in turn communicates with center depression 106 and the pump outlet.

Thus, there is disclosed in the above description and in the drawings an improved reversible pump which fully and effectively accomplishes the objectives thereof. However, it will be apparent that variations and modifications of the disclosed embodiment may be made without departing from the principles of the invention or the scope of the appended claims.

I claim:

1. In a reversible, rotary fluid pump including a housing defining a pumping chamber, fluid outlet means, rotary pumping means disposed within said pumping chamber rotating about an axis, and a shaft for driving said pumping means; the improvement comprising:

a single fixed inlet port communicating directly with said pumping chamber and with said pumping means at the same point of said pumping chamber in all operable conditions of said pumping means;

a fluid inlet passageway in fluid communication with said inlet port; and a movable valve plate disposed in frictional engagement with said pumping means, axially disposed from said pumping means, and being adapted for limited rotational movement to one of two operative positions in accordance with the direction of rotation of said pumping means, said valve plate having passageway means formed therein for directing fluid flow from said pumping chamber to said fluid outlet means in each of said operative positions.

2. In a reversible, rotary fluid pump including a housing defining a pumping chamber, fluid outlet means, rotary pumping means disposed within said pumping chamber rotating about an axis, and a shaft for driving said pumping means; the improvement comprising:

a single fixed inlet port opening directly into said pumping chamber at the same point in all operable conditions of said pumping means;

a fluid inlet passageway in fluid communication with said inlet port; and a movable valve plate disposed in frictional engagement with said pumping means, axially disposed from said pumping means, and being adapted for limited rotational movement to one of two operative positions in accordance with the direction of rotation of said pumping means, said valve plate having passageway means formed therein for directing fluid flow from said pumping chamber to said fluid outlet means in each of said operative positions.

3. In a reversible, rotary fluid pump including a housing defining a pumping chamber, fluid outlet means, rotary pumping means disposed within said pumping chamber, and a shaft for driving said pumping means; the improvement comprising:

a single fixed inlet port communicating with said pumping chamber and with said pumping means at the same point of said pumping chamber in all operable conditions of said pumping means;

a fluid inlet passageway in fluid communication with said inlet port; and valving means disposed in frictional engagement with and axially spaced from said pumping means and being adapted for limited rotational movement to one of two operative positions in accordance with the direction of rotation of said pumping means, said valving means comprising channel means communicating with said pumping means, said channel means extending along the periphery of said valving means, and porting means for directing fluid flow from said peripheral channel means to said outlet means in both of said operative positions.

4. A pump as set forth in claim 3 wherein said valving means comprises a valve plate and biasing means for urging said valve plate into frictional engagement with said pumping means.

5. A pump as set forth in claim 4 wherein said porting means includes an opening extending axially through said valve plate for conducting fluid from said peripheral channel means to said outlet means.

6. A pump as set forth in claim 5 wherein said opening is positioned radially inwardly from said peripheral channel means and said valve plate includes a radially extending passage for placing said peripheral channel and said opening in fluid communication.

7. A pump as set forth in claim 4 further comprising stop means engageable with said valve plate to limit said rotational movement thereof.

8. A pump as set forth in claim 7 wherein said valve plate includes an elongated recess and said stop means comprises a projection extending into said recess and cooperating with opposite ends thereof to limit said rotational movement.

9. A pump as set forth in claim 4 wherein said porting means comprises a nonrotatable porting plate positioned between said valve plate and said biasing means, said porting plate including passage means for conducting fluid from said valve plate to said outlet when said valve plate is in either of said two operative positions.

10. A pump as set forth in claim 3 wherein said channel means includes a pair of circumferentially spaced peripheral channels provided on said valve means, one of said channels being operative to conduct fluid in each of said two operative positions.

11. A pump as set forth in claim 10 wherein said porting means includes axially extending passage means provided in said valve means positioned radially inwardly from said pair of channels and radially extending passage means for placing said peripheral channels in fluid communication with said axially extending passage means.

12. A pump as set forth in claim 11 wherein said porting means further includes a porting plate positioned in engaging relationship with said valve means, said porting plate having first and second passage means, one of said first and second passage means being in fluid communication axially extending passage means when said valve means is in one of said operative positions and the other of said first and second passage means being in fluid communication with said axially extending passage when said valve means is in the other of said operative positions.

13. A reversible, rotary fluid pump comprising:

(a) a housing defining a cylindrical pumping chamber;

(b) a fluid inlet passageway communicating with said pumping chamber;

(c) a cylindrical rotatable rotor eccentrically positioned in said chamber, said rotor having at least one vane slidably attached thereto and in sealing and slidable contact with the inner wall of said chamber, said chamber, rotor and at least one vane defining two pumping cavities of increasing and decreasing displacement when said rotor rotates, wherein said fluid inlet passageway communicates with said chamber at the mid-point of each of said cavities when said cavities are at maximum displacement;

(d) means for driving said rotor;

(e) a first fluid outlet port communicating with said chamber at the point each of said cavities approaches a point of minimum displacement for one direction of rotation of said rotor;

(f) a second fluid outlet port communicating with said chamber at the point each said cavity approaches a point of minimum displacement for the opposite direction of rotation of said rotor;

(g) fluid outlet means;

(h) a movable valve plate in frictional engagement with said rotor and rotatable between two operative positions, said valve plate having a first bore and a second bore extending therethrough; and (i) a porting plate having a face engaging said valve plate, said porting plate having first and second channels in said face, each extending to a position on said porting plate where they both communicate with said outlet means, said first channel being in communication with said first bore when said valve plate is rotated to its clockwise operative position and said second channel being in communication with said second bore when said valve plate is rotated to its counterclockwise operative position.

14. In a reversible, rotary fluid pump including a housing defining a pumping chamber, fluid inlet means communicating with said pumping chamber, fluid outlet means, rotary pumping means disposed within said pumping chamber, and a shaft for driving said pumping means; the improvement comprising:

valving means including a movable valve plate disposed in frictional engagement with said pumping means and being adapted for limited rotational movement between clockwise and counterclockwise operative positions in accordance with the direction of rotation of said pumping means, said valve plate having first and second bores extending therethrough, said valving means further comprising a porting plate having a face engaging said valve plate for directing fluid flow from said pumping chamber to said outlet means in both of said operative positions, said porting plate having first and second channels in said face, each being positioned on said porting plate in fluid communication with said outlet means, said first channel being in fluid communication with said first bore when said valve plate is rotated to said clockwise operative position and said second channel being in communication with said second bore when said valve plate is rotated to said counterclockwise operative position, said valving means being completely separate from said inlet means.

15. A pump in accordance with claim 14 wherein said valving means is axially spaced from said pumping means.

16. A pump in accordance with claim 14 further comprising stop means for limiting clockwise and counterclockwise rotation of said valve plate whereby said valve plate may be positioned in said clockwise or said counterclockwise operative position upon rotation thereof.

17. A pump in accordance with claim 14 wherein said pumping chamber is supplied inlet fluid by the same inlet passageway for both directions of rotation of said pumping means.

18. A pump in accordance with claim 14 wherein said rotary pumping means comprises a cylindrical rotatable rotor eccentrically positioned in said pumping chamber having at least one vane, said chamber, rotor and at least one vane defining two pumping cavities of increasing and decreasing displacement when said rotor rotates.

19. A pump in accordance with claim 18 wherein said fluid inlet means communicates with said pumping chamber at the midpoint of each of said cavities when said cavities are at maximum displacement.

20. In a reversible rotary fluid pump including a housing defining a pumping chamber, fluid outlet means, rotary pumping means disposed within said pumping chamber for rotation about an axis, and a shaft for driving said pumping means; the improvement comprising: a single fixed inlet port communicating with said pumping chamber and with said pumping means in all operable conditions of said pumping means, said pumping means comprising a double vane pump rotatable about said axis and providing two pumping cycles per revolution of said shaft; a fluid inlet passageway in fluid communication with said inlet port; and valving means disposed in axially adjacent frictional engagement with said pumping means and being adapted for limited rotational movement to one of two operative positions in accordance with the direction of rotation of said pumping means, said valving means including fluid passage means extending radially inwardly from the periphery of said valve means for directing fluid flow from said pumping chamber to said outlet means.

* * * * *